US005821865A

United States Patent [19]

Solak

[11] Patent Number: 5,821,865

[45] Date of Patent: Oct. 13, 1998

[54] CHRISTMAS ORNAMENT HAZARD DETECTOR

[76] Inventor: David M. Solak, 4805 Maple Hill Dr., Seven Hills, Ohio 44131

[21] Appl. No.: 859,974

[22] Filed: May 21, 1997

[51] Int. Cl.[6] ..... G08B 17/10

[52] U.S. Cl. ..... 340/628; 340/628; 340/629

[58] Field of Search ..... 340/628, 632, 340/693, 539, 825.36, 629; 455/127

[56] References Cited

U.S. PATENT DOCUMENTS

| | | | |
|---|---|---|---|
| 3,806,921 | 4/1974 | Pappas | 340/412 |
| 4,075,614 | 2/1978 | White | 340/628 |
| 4,623,878 | 11/1986 | Schoenwetter | 340/628 |
| 4,845,474 | 7/1989 | Moore et al. | 340/629 |
| 4,924,206 | 5/1990 | Ayers | 340/426 |
| 5,396,221 | 3/1995 | Bridges | 340/628 |
| 5,589,824 | 12/1996 | Lynch | 340/628 |
| 5,625,345 | 4/1997 | Stark et al. | 340/628 |

*Primary Examiner*—Thomas J. Mullen, Jr.
*Assistant Examiner*—Toan N. Pham
*Attorney, Agent, or Firm*—Chase & Yakimo

[57] ABSTRACT

A smoke/heat detector in the form of a Christmas tree ornament utilizes a spherical ornament housing divided by a fire-resistant barrier into lower and upper chambers. A transmitter circuit is mounted atop the barrier and transmits signals to a remote receiver upon detection of entry of smoke or heat into the lower chamber by means of sensors therein. Upon receipt of the transmitted signals by a remote receiver, an energized alarm circuit sounds an alarm indicative of the smoke or fire presence. Both circuits include SCR components and internal power sources so that the circuits, once initially energized, will continue to transmit signals and/or sound the alarm after initial start up.

11 Claims, 8 Drawing Sheets

CHRISTMAS ORNAMENT HAZARD DETECTOR

BACKGROUND OF THE INVENTION

This invention pertains to a smoke and/or heat detector and, more particularly, to a detector adapted for ornamental display and use on a Christmas tree.

Various fire detectors have been proposed for detection of Christmas tree fires. One such detector is shown in U.S. Pat. No. 5,396,221 to Bridges. Various prior art smoke detectors are discussed therein as well as a disclosure of a smoke detector in the form of a Christmas tree ornament, a glowing red light on the ornament indicating that the smoke detector is in a ready state.

Although assumably effective in operation, one problem with past detectors is that the intense blaze of a Christmas tree fire can immediately destroy the detector as measured from the time of ignition. Thus, although an alarm may sound, it may be a relatively short one which may not be heard by the home occupants particularly if they are sleeping in a bedroom remote from the Christmas tree location. In turn, the failure to hear such an alarm will allow the fire to spread which may lead to dire consequences.

Accordingly, it is desirable to provide a system which can deliver an alarm to home occupants for an extended period of time after the device senses the presence of heat and/or smoke caused by a Christmas tree.

SUMMARY OF THE INVENTION

In response thereto I have invented a smoke and/or heat detector having a transmitter circuit in a Christmas tree ornament. The ornament includes a ceramic wafer which separates the ornament into a lower detection chamber and an upper chamber containing the transmitter components. The transmitter includes heat and smoke sensors in the lower chamber of the ornament which communicates with the outside air by means of vents in the ornament. Upon smoke or heat entering this lower chamber the sensors cause transmission of a signal to a remote receiver which causes an alarm to sound. Upon receipt of the transmitted signals, the energized alarm circuit locks into an alarm mode as energized by its own power. Accordingly, the alarm continues to sound even after the destruction of the transmitter circuit in the ornament by the Christmas tree fire. This action elongates the alarm warning to the building occupants. The upper chamber initially protects the transmitter components from fire so as to prolong the delivery of transmitter signal to the remote receiver.

Accordingly, it is a general object of this invention to provide a warning device for sensing and warning occupants of the presence of a Christmas tree fire.

Another object of this invention is to provide a device, as aforesaid, which can sense smoke and/or heat emanating from a Christmas tree fire.

A further object of this invention is to provide a device, as aforesaid, having a signal transmitter in the form of a Christmas tree ornament for sending energizing signals to a remote alarm.

Another further object of this invention is to provide a device, as aforesaid, the ornament having a lower detection chamber in communication with the ambient air and an upper chamber isolated from the ambient air for containing the transmitter circuit therein.

A further particular object of this invention is to provide a device, as aforesaid, the ornament having a protective barrier between the detection chamber and the transmitter assembly chamber.

Another object of this invention is to provide a device, as aforesaid, which utilizes a remote alarm, the alarm being designed to continuously sound after initial energization.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
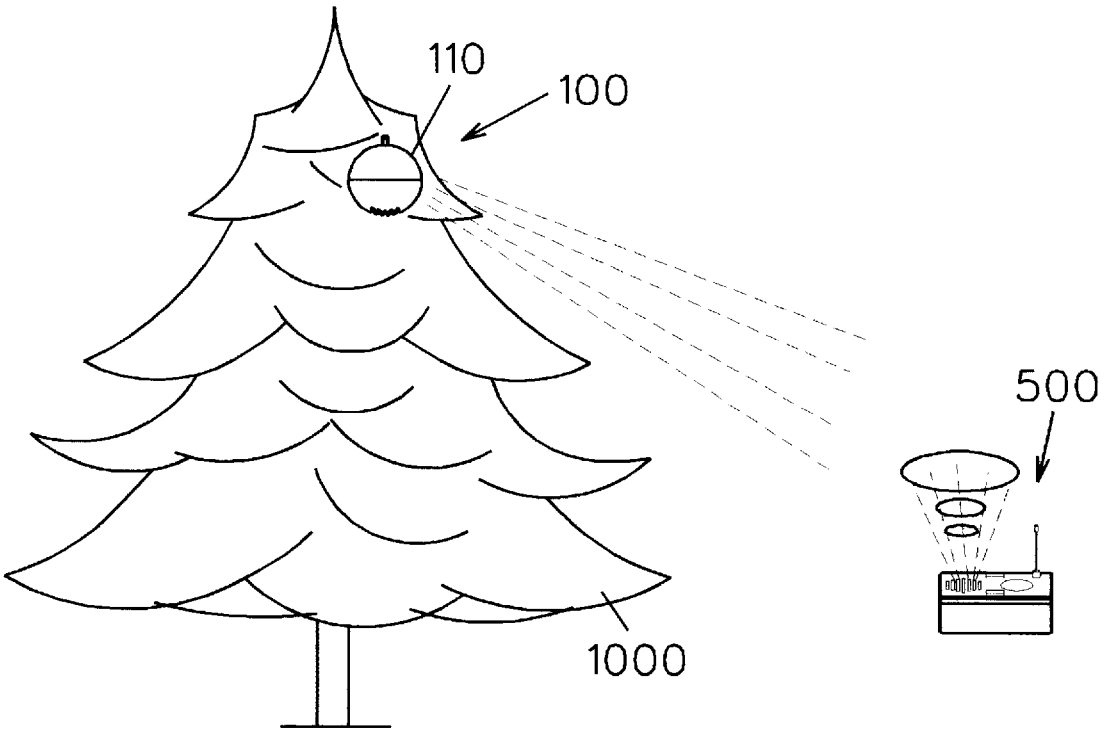
FIG. 1 is a diagrammatic view showing the Christmas tree ornament on a Christmas tree with the receiver/alarm assembly displaced therefrom.
Figure 2:
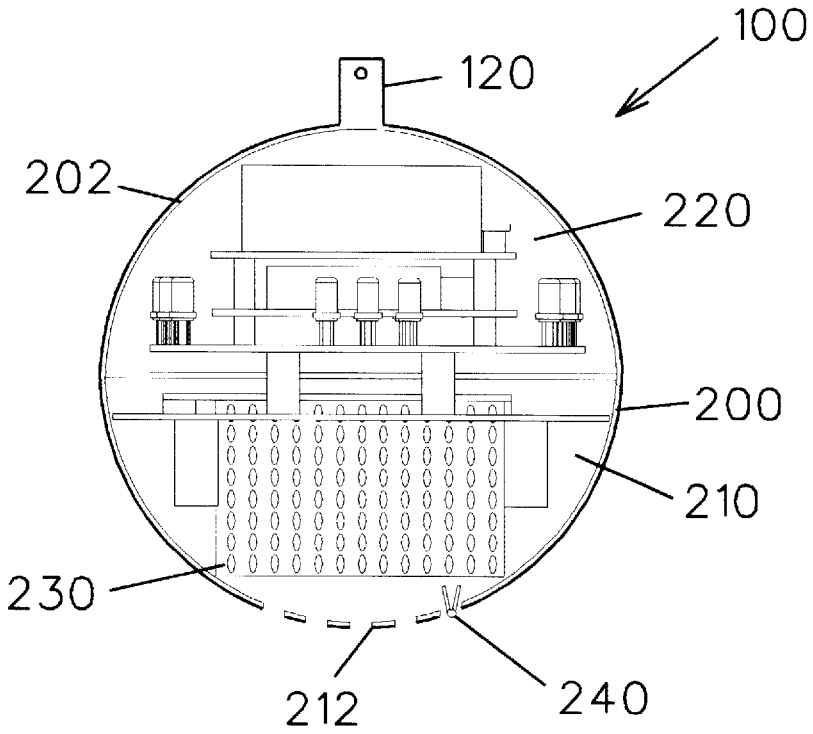
FIG. 2 is an enlarged view of the bulb of the Christmas tree showing the interior transmitter component of the bulb.
Figure 3:
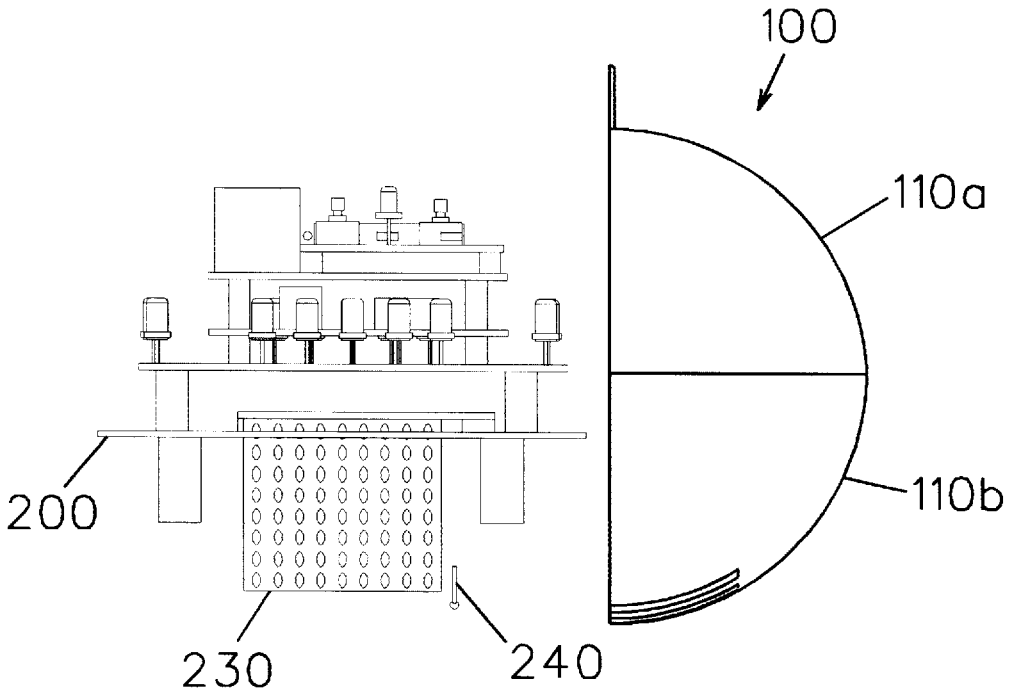
FIG. 3 is a right side view of the bulb component of FIG. 2.
Figure 4:
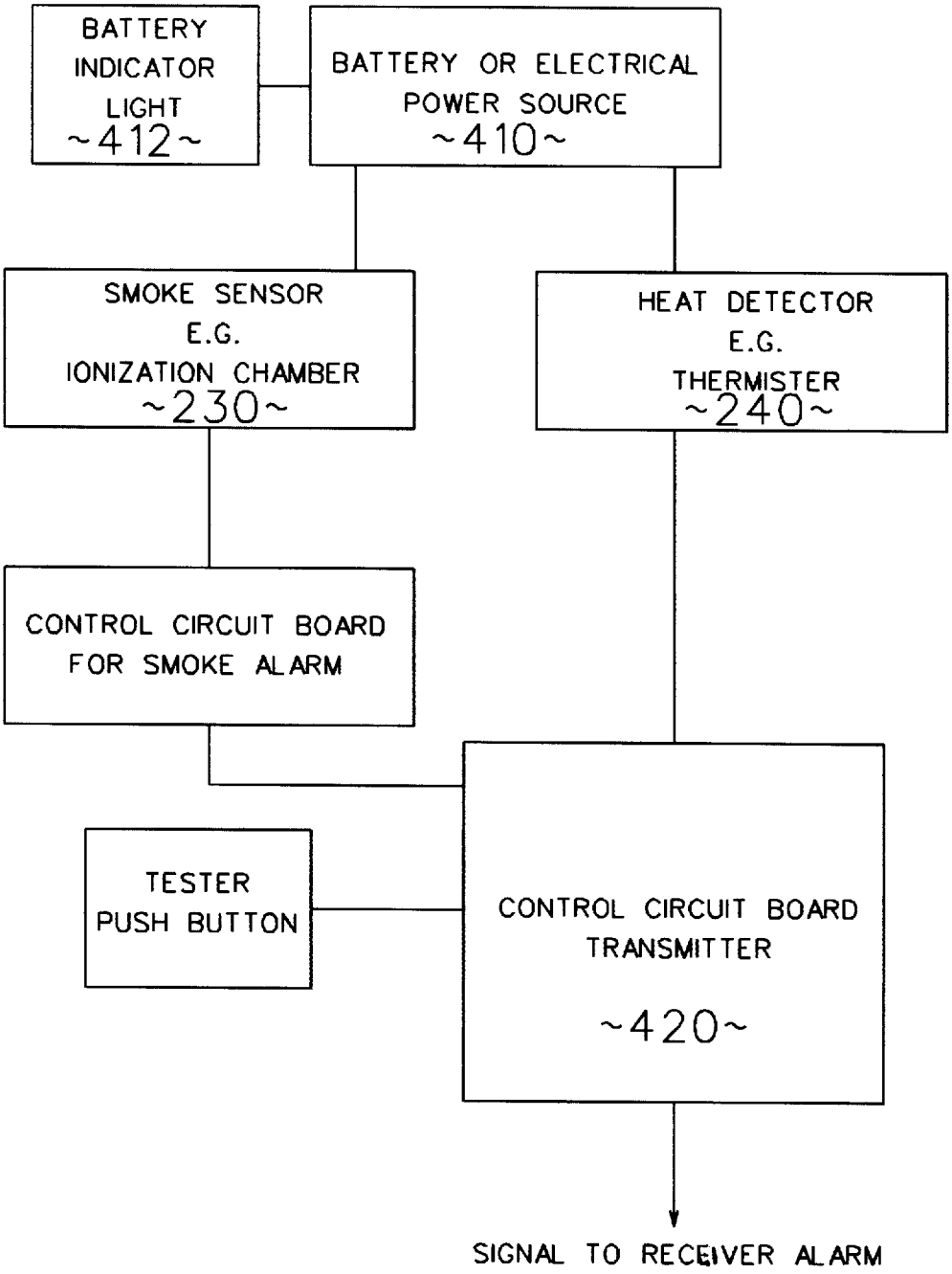
FIG. 4 is a block diagram of the transmitter circuit.
Figure 5:
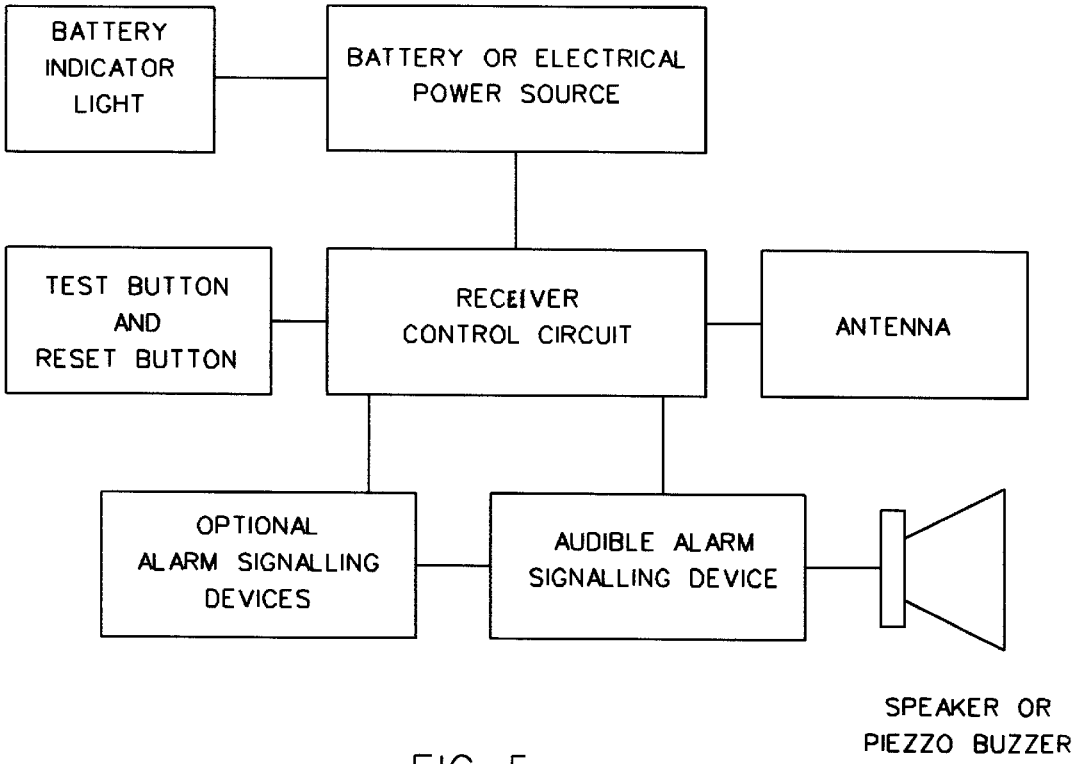
FIG. 5 is a block diagram of the receiver circuit.

Turning more particularly to the drawings, FIG. 1 shows the ornament 100 on a Christmas tree 1000, the ornament including a transmitter circuit (FIGS. 4, 6) for sending signals to a remote receiver 500. The ornament 100 comprises a spherical housing 110 with a hook 120 for hanging the housing 110 from a limb of the tree 1000. Housing 110 may be constructed to be releasably separable into two halves 110*a*, 110*b* to allow access to the interior thereof.

The housing 110 includes a heat resistant ceramic wafer 200 which divides the interior of the housing 110 into lower 210 and upper 220 chambers. The interior of the entire bulb may also include a ceramic lining 202. The lower chamber 210 includes a plurality of orifices 212 which communicates the lower chamber 210 with the outside ambient air.

Extending from wafer 200 and into chamber 210 is a smoke-detecting sensor 230 which is a part of the transmitter circuitry. A heat detector 240, likewise incorporated into the transmitter circuitry, is adjacent one of the orifices 212.

Figure 6:
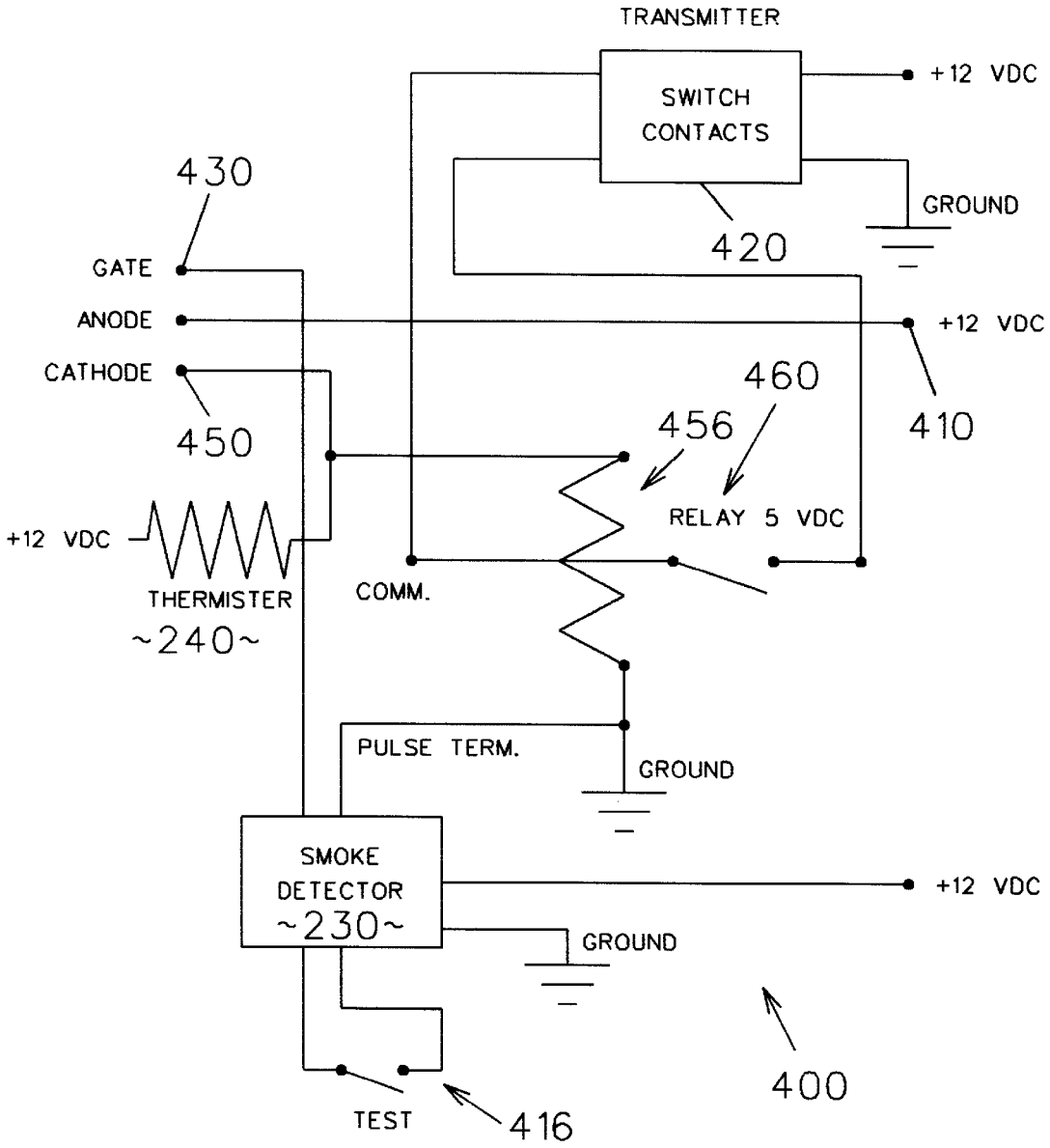
FIG. 6 illustrates one form of circuitry for the transmitter.

As above stated, the sensors 230, 240 are in communication with transmitter circuitry as best shown in FIG. 6. The transmitter circuitry 400 (FIGS. 4, 6) includes a power source 410, e.g., a camera battery, which energizes a battery indicator light 412 to indicate suitable power. The sensors 230, 240 normally present a DC open which upon detection of predetermined threshold levels or smoke and/or heat within chamber 210 will in combination with other circuit components cause the circuit to close so as to energize the transmitter 420.

As shown in FIG. 6, a SCR is provided. Thus, once a threshold level of smoke or heat is sensed by the respective sensors 230, 240, the gate 430 is tripped. In turn, a current flow from the emitter cathode 450 through coil 456 will close relay 460 so as to energize the transmitter 420. Accordingly, signals are transmitted to receiver 500. As the upper chamber 220 is protected from the heat/smoke by wafer 200 and lining 202, the period of transmission will be elongated even in the presence of fire.

The smoke sensor 230 cooperates with the lower chamber 210 so as to form an ionization chamber for the collection of smoke particles therein. Thus, upon initial ignition, the smoke will enter this lower chamber 210. Likewise, heat will be sensed by sensor 240 which may be in the form of a thermistor. It is understood that various forms of circuitry can be used. However, it is desired that the transmitter circuit once energized will continue to transmit until delivery of power is ceased or the circuit is destroyed.

Figure 7:
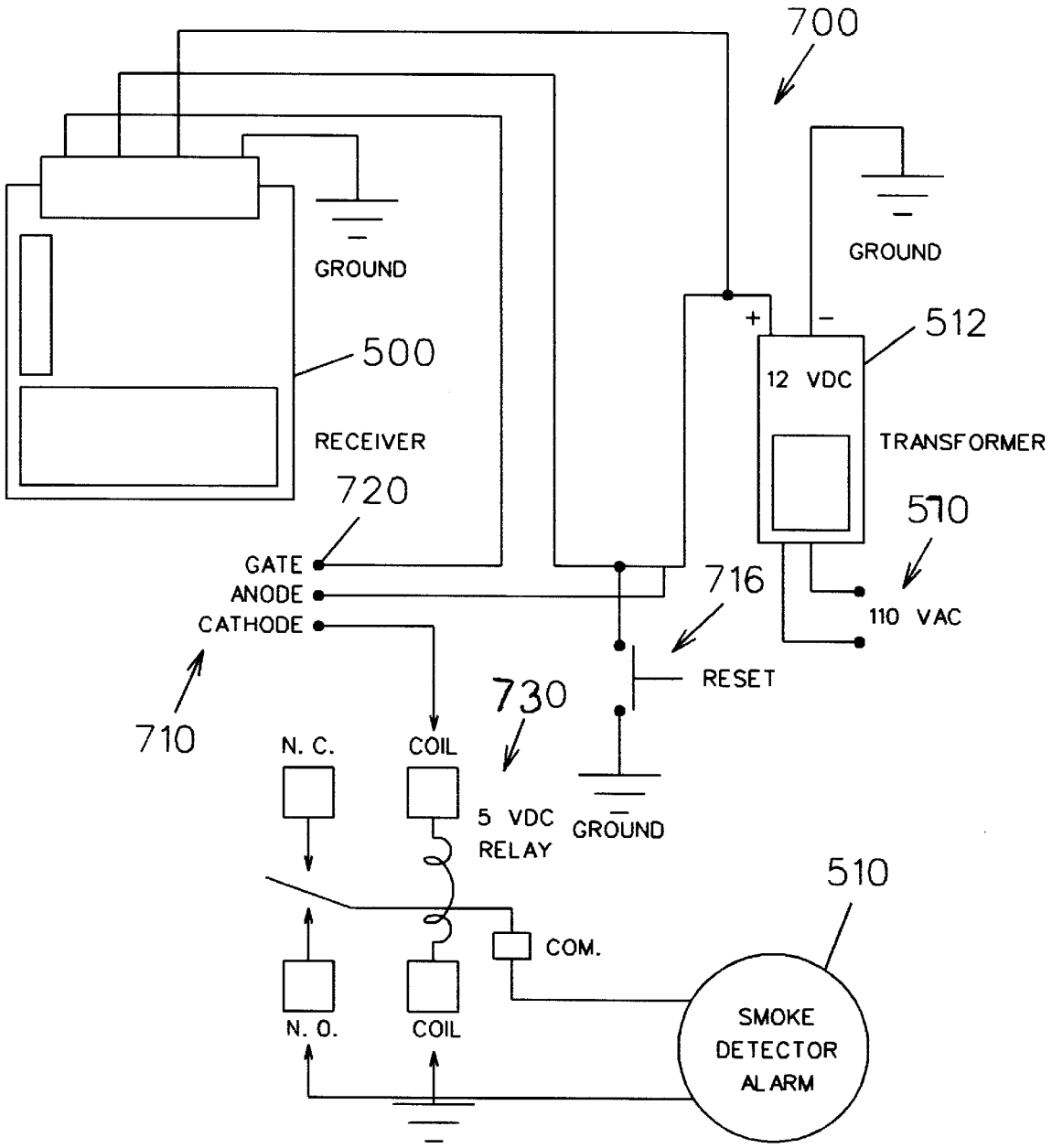
FIG. 7 illustrates one form of circuitry for the receiver.
Figure 8:
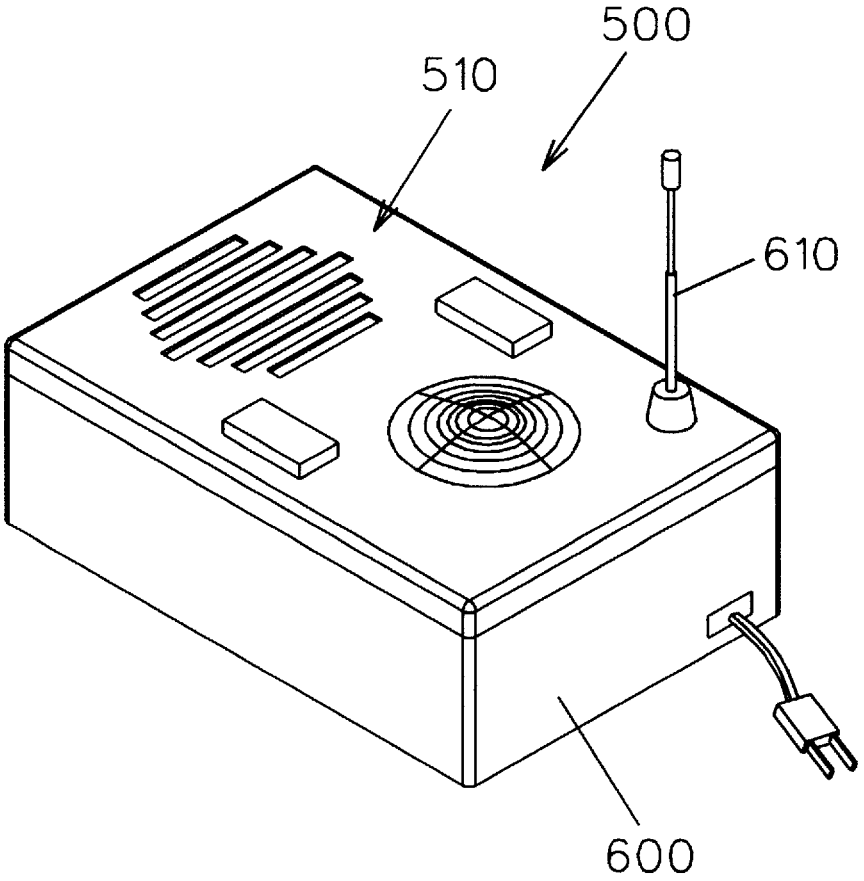
FIG. 8 is a perspective view of the remote receiver/alarm component.

As shown in the FIG. 8, a receiver 500 with alarm 510 is enclosed in a housing 600 with an antenna 610 extending therefrom for receiving the transmitted signals. Receiver is shown as being powered by house current 570/transformer 512 combination. As best shown in FIG. 7, an SCR latching circuit 700 is associated with receiver 500. Upon receipt of the transmitted signals, the SCR 710 gate 720 closes causing a current flow to the relay 730 of the associated smoke detector alarm. Once the relay closes the alarm 510 sounds irrespective of the cessation of reception of transmitted signals from ornament 100. As such, this continuous alarm will enable the building occupants to take the appropriate evasive action.

Test buttons may also be incorporated into the transmitter (416 shown) and alarm circuits to confirm operation and reset the same to a ready (716 shown) state.

During the initial fire ignition, it can be appreciated that the ceramic wafer 200 with or without lining 202 extending across the spherical housing 110 initially protects the transmitter assembly in the chamber 220 from the surrounding heat and fire. Once the sensors 230, 240 detect the appropriate smoke and/or heat, the receiver/alarm circuit continues to function irrespective of destruction of the transmitter circuit 400.

Accordingly, once appropriate signals are received by the remote receiver 500 the alarm 510 will sound.

Thus, the use of the transmitter and remote receiver 500 with alarm in the form of SCR latching circuit provides for an effective apparatus for detection and warning of Christmas tree fires which have not been addressed in the prior art.

It is to be understood that while a certain form of this invention has been illustrated and described, it is not limited thereto except insofar as such limitations are included in the following claims and allowable functional equivalents thereof.

What is claimed is:

1. A smoke and fire alarm device for a Christmas tree comprising:

a housing;

a fire-resistant barrier traversing an interior of said housing for dividing said interior of said housing into discrete isolated lower and upper compartments, said upper compartment further isolated from outside ambient air;

apertures in said housing about said lower compartment for communicating said lower compartment with outside ambient air;

a normally open transmitter circuit means in said upper compartment and mounted on said barrier for transmitting signals to a remote receiver, said circuit means including:

a heat sensor in said lower compartment adjacent one of said apertures for closing said circuit means upon detecting a predetermined amount of heat entering said lower compartment through said apertures;

a smoke sensor in an interior of said lower compartment for closing said circuit means upon detecting a predetermined amount of smoke particles collected in said lower compartment upon entry through said apertures;

a remote receiver exterior of said housing for receiving said transmitted signal;

a remote normally open alarm circuit in communication with said receiver for sounding an alarm upon reception of said transmitted signals by said receiver, whereby to sound an alarm upon said detection of said predetermined heat or smoke particles collected in said lower compartment.

2. The device as claimed in claim 1 wherein said transmitter circuit means includes a power source and a silicone-controlled rectifier activated by one of said smoke or heat sensors for controlling delivery of power to said transmitter circuit means from said power source.

3. The device as claimed in claim 1 wherein said barrier comprises a fire-resistant wafer mounted in said housing, said wafer resisting an entry of heat in said upper compartment.

4. The device as claimed in claim 1 wherein said barrier comprises:

a fire-resistant wafer presenting a base in said upper compartment of said housing for mounting said transmitter circuit means thereon;

a fire-resistant lining about an interior of said housing, said lining and said base resisting entry of heat in said isolated upper compartment.

5. The device as claimed in claim 1 wherein said alarm circuit includes a power source and a silicone-controlled rectifier activated upon receipt of transmitter signals by said receiver for controlling delivery of power to said alarm circuit from said power source.

6. A smoke and fire alarm device for a Christmas tree comprising:

a housing adapted to represent an ornament on a Christmas tree, said housing having upper and lower compartments wholly within said housing, each of said compartments having an exterior surface formed by a portion of said housing;

a fire-resistant barrier in said housing for forming a common interior wall of said compartments, said barrier traversing an interior or said housing for isolating said upper compartment from said lower compartment;

a plurality of vents in said portion of said housing of said lower compartment for communicating said lower compartment with outside ambient air, said housing portion of said upper compartment isolating said upper compartment from the outside ambient air;

a normally open transmitter circuit in said upper compartment for transmitting signals to a remote receiver, said circuit including:

a heat sensor in said lower compartment and adjacent at least one of said vents for closing said circuit upon detecting a predetermined amount of heat entering said lower compartment through said vents;

a smoke sensor in said lower compartment for closing said circuit upon detecting a predetermined amount of smoke entering said lower compartment through said vents;

a remote receiver for receiving said transmitted signal;

a normally open remote alarm circuit in communication with said receiver for sounding an alarm upon reception of said transmitted signals by said receiver, whereby to sound an alarm upon entry of said amount of smoke or heat into said lower compartment.

7. The device as claimed in claim 6 wherein said transmitter circuit includes a power source and silicone-controlled rectifier activated by said smoke or heat sensors for controlling delivery of power to said transmitter circuit from said power source.

8. The device as claimed in claim 6 wherein said barrier comprises a ceramic wafer mounted in said housing.

9. The device as claimed in claim 6 wherein said barrier comprises:

a fire resistant base for presenting said common interior wall of said upper and lower compartments;

a fire resistant lining about an interior of said upper compartment whereby to resist entry of heat into said compartment through said base and said housing portion forming said upper compartment.

10. The device as claimed in claim 6 wherein said alarm circuit includes a power source and associated silicone-controlled rectifier for powering said alarm upon receipt of said transmitter signals by said receiver.

11. A smoke and fire alarm for a Christmas tree comprising:

a housing;

means for dividing an interior of said housing into thermally isolated lower and upper compartments; said upper compartment further isolated from outside ambient air;

means in said housing for communicating said lower compartment with outside ambient air;

a normally open transmitter circuit in said upper compartment for transmitting a signal upon closure thereof to a remote receiver, said circuit including:

a heat sensor in said lower compartment adjacent said communicating means for closing said circuit upon detecting a predetermined amount of heat in said lower compartment;

a smoke sensor in said lower compartment for closing said circuit upon detecting a predetermined amount of smoke collected in said lower compartment by said communicating means;

a remote receiver for receiving said transmitted signal;

a normally open remote alarm circuit in communication with said receiver for sounding an alarm upon closure thereof upon reception of said transmitted signals by said receiver.

* * * * *